US006854459B1

(12) United States Patent
Cox

(10) Patent No.: US 6,854,459 B1
(45) Date of Patent: Feb. 15, 2005

(54) HEAD ENCLOSING TREATMENT HOOD

(76) Inventor: Gerald L. Cox, 1987 S. Park Rd., Louisville, KY (US) 40219

( * ) Notice: Subject to any disclaimer, the term of this patent is extended or adjusted under 35 U.S.C. 154(b) by 49 days.

(21) Appl. No.: 10/237,223

(22) Filed: Sep. 6, 2002

Related U.S. Application Data

(63) Continuation-in-part of application No. 09/855,378, filed on May 15, 2001, now abandoned, which is a continuation-in-part of application No. 09/585,970, filed on Jun. 2, 2000, now Pat. No. 6,701,920.

(51) Int. Cl.[7] ..... A62B 17/04; A62B 18/00

(52) U.S. Cl. ..... 128/201.23; 128/201.22; 2/171.3; 2/205; 2/6.2

(58) Field of Search ..... 128/200.24, 201.22, 128/201.23, 201.25, 201.28, 201.29, 206.21, 206.23, 206.24, 206.28, 207.11; 2/2.15, 171.3, 205, 202, 2.17, 5, 6.1, 6.2, 6.6, 421, 422, 2.14, 2.1

(56) References Cited

U.S. PATENT DOCUMENTS

| | | | | |
|---|---|---|---|---|
| 1,159,125 | A | | 11/1915 | Stelzner |
| 3,098,233 | A | * | 7/1963 | Hoagland ..... 2/424 |
| 3,221,339 | A | | 12/1965 | Correale, Jr. |
| 3,534,408 | A | | 10/1970 | Fifield |
| 3,559,209 | A | | 2/1971 | Vail |
| 3,562,813 | A | | 2/1971 | Origer |
| 3,574,862 | A | | 4/1971 | Jones |
| 3,958,275 | A | | 5/1976 | Morgan et al. |
| 4,015,294 | A | | 4/1977 | O'Neill |
| 4,015,295 | A | | 4/1977 | Lancaster et al. |
| 4,057,058 | A | | 11/1977 | Kovacevic |
| 4,062,079 | A | | 12/1977 | Potter |
| 4,091,465 | A | | 5/1978 | Webbon et al. |
| 4,172,294 | A | | 10/1979 | Harris |
| 4,236,514 | A | | 12/1980 | Moretti |
| 4,411,264 | A | | 10/1983 | Jacobson |
| 4,452,240 | A | | 6/1984 | Moretti |
| 4,455,687 | A | | 6/1984 | Johansson |
| 4,458,680 | A | * | 7/1984 | Childers et al. ..... 128/201.29 |
| 4,620,538 | A | | 11/1986 | Koegel et al. |
| 4,627,431 | A | | 12/1986 | Werjefelt |
| 4,639,945 | A | | 2/1987 | Betz |
| 4,683,880 | A | | 8/1987 | Werjefelt |
| 5,044,017 | A | | 9/1991 | Kirby et al. |
| 5,113,854 | A | | 5/1992 | Dosch et al. |
| 5,226,409 | A | | 7/1993 | Bower et al. |
| 5,322,245 | A | | 6/1994 | Bassick |
| 5,575,278 | A | | 11/1996 | Bonhomme et al. |
| 5,819,728 | A | | 10/1998 | Ritchie |
| 5,839,432 | A | | 11/1998 | Daneshvar |
| 5,865,175 | A | | 2/1999 | Chu |
| 5,996,580 | A | * | 12/1999 | Swann ..... 128/206.17 |

* cited by examiner

*Primary Examiner*—Henry Bennett
*Assistant Examiner*—Andrea M. Ragonese
(74) *Attorney, Agent, or Firm*—James E. Cole; John F. Salazar; Middleton Reutlinger

(57) ABSTRACT

A head enclosing gas hood for treating respiratory ailments is placeable over a patient's head for providing a gas, preferably oxygenated, to said patient. The treatment gas hood has a hood portion which is connected to a hood ring. The hood ring slides over a two-piece neck ring, the two-piece neck ring consisting of an upper neck ring and a lower neck ring retained in adjacent relationship. The hood ring slides over the two-piece neck ring and forms a sealing relationship therewith. The two-piece neck ring has a neck seal retained therein and has a sealing ring on the outer periphery thereof for engagement with the working surface of the hood ring. Ports may be provided for directing a flow of a gas into and from the interior portion of the hood where the individual's head is located. The neck seal provides an adequate seal between the neck ring and the individual's neck such that a pressurized environment may be created in the hood if desired. The hood may also be used to create a local environment different from ambient, such as rich in oxygen for the patient to breathe without pressurizing the hood. The two-piece neck ring may also have a retaining ring for holding the neck seal in place after the upper and lower neck rings are retained together.

27 Claims, 12 Drawing Sheets

HEAD ENCLOSING TREATMENT HOOD

CROSS REFERENCE TO RELATED APPLICATIONS

This application is a continuation-in-part of U.S. Ser. No. 09/855,378 filed on May 15, 2001, now abandoned which is a continuation-in-part of U.S. Ser. No. 09/585,970 filed on Jun. 2, 2000 now U.S. Pat. No. 6,701,920.

FIELD OF THE INVENTION

This invention relates to a head enclosing gas hood for covering of a person's head for treating respiratory ailments.

BACKGROUND OF THE INVENTION

A variety of head enclosing treatment hoods have been developed for use in the delivery of gas, including oxygen, to the wearer. Such a delivery system may be desirable for directing clean air or other gases into the hood for breathing by the wearer. This function is also desirable in use as a hyperbaric oxygen treatment system wherein the patient is exposed to increased barometric pressure inside a decompression chamber, while wearing the hood device and receiving an oxygen rich environment. It may be desirable to have such a head enclosing treatment hood wherein the hood is transparent so the wearer can see outside of the device and so that an adequate seal is provided between the wearer and the enclosing treatment hood.

In many different instances, patients must have their entire head enclosed in a treatment hood or wearing an aerosol mask device to receive the prescribed pressurized air or gas treatment. It is therefor desirable to have the transparent hood surrounding the patient's head and also having an efficient assembly for connecting the hood with a neck ring and a neck seal forming a seal around the patient's neck and allowing the hood area of the device to be filled with the treatment gas, often times pressurized. It is therefor essential that an adequate seal be made between the hood and the hood ring retaining the hood as well as between the hood ring and the neck ring and neck seal.

Various hoods are disclosed in the prior art including U.S. Pat. No. 5,226,409, U.S. Pat. No. 4,620,538 and U.S. Pat. No. 5,819,728. In all of these prior art devices, various hood and neck ring assemblies are disclosed. However, in these designs, there is no teaching of a simplified sealing and connection-system between the hood ring and the neck ring and neck seal. Some of the devices disclosed in the above-referenced patent have complex or difficult structures to ensure sealing between the neck ring and neck seal and also include structure which does not readily retain the proper pressure within the hood. It is also found in these prior art devices that after repeated wear on various surfaces of the devices, the seal between the hood and the hood ring may be corrupted. It is further noted that the prior art devices include complex or difficult attachment processes for affixing the neck seal to the neck ring or in assembly of the device. All of these shortcomings are resolved by the design of the head enclosing gas hood of the present invention.

Moreover, in the treatment of respiratory ailments, performed outside a pressurized environment, masks which are placed over the nose and mouth with elevated air flow rates have become widely acceptable. However, theses masks have been found to be extremely uncomfortable by the respiratory patient, resulting in a decreased compliance with the prescribed treatment regimen.

SUMMARY OF THE INVENTION

It is therefor an object of the present invention to provide a head enclosing treatment hood wherein the hood seal is attached to a hood ring.

It is a further object of the present invention to provide a neck ring wherein the hood ring seal is engaged with the neck ring and the neck ring further contains a neck seal which adequately seals around a patient's neck.

An additional object of the present invention is to provide a two-piece neck ring for attachment and retaining of the neck seal.

It is a further object of the present invention to provide a neck seal which is attached to the neck ring and which does not require the end user to perform an assembly step and wherein the neck seal may be securely retained within the two-piece neck ring upon shipment by the manufacturer.

A further object of the present invention is to provide a novel hood ring design wherein the attachment point between the hood and the hood ring is not located on a working and sealing surface between the hood ring and the neck ring.

An additional object of the present invention is to provide a device port through the neck ring allowing monitoring devices to be inserted into the interior portion of the gas treatment hood of the head enclosing gas hood.

An even further object of the present invention is to provide a two-piece neck ring wherein the upper and lower pieces of the neck ring may be pre-assembled and wherein the neck seal, in this pre-assembly step, is firmly retained in between the upper and lower neck rings.

Another object of the present invention is to provide a method for treating respiratory ailments with the use of a pressurized treatment hood.

These and other objects are resolved by the design of the head enclosing gas treatment hood of the present invention. The head enclosing gas treatment hood of the present invention is comprised of a hood which is affixed to a hood ring, the affixation point of the hood to the hood ring placed somewhere on the non-working surface of the hood ring. The hood ring slides over a neck ring in sealing engagement thereto. The neck ring of the present invention is a novel two-piece neck ring which has the neck seal compressed in between the upper neck ring and the lower neck ring in such a manner as to provide a sealing relationship to the interior of the hood and around the user's head. The upper and lower neck ring have both a retaining O-ring and a sealing O-ring secured firmly therebetween both of which act to either retain the neck seal or firmly seal the upper and lower neck rings with the hood ring. The head enclosing gas hood of the present invention also includes a neck seal which, as discussed above, is retained between the upper neck ring and lower neck ring and which extends inwardly from the neck ring. The neck seal is made of a gas impermeable material and stretches around the users neck to seal the interior portion of the hood and allow the interior portion to be filled with the supplied gas.

One advantage of the present design is that the upper and lower neck ring may be assembled easily with the neck seal compressed therebetween. Thus, the prior art designs which require assembly of the neck ring by stretching or by retention in specially constructed rings is overcome with a simplified design which compresses the seal between the neck ring pieces.

The present invention also provides a method for treating respiratory conditions which includes placing a hood over the head of a user wherein the hood is of a flexible gas impervious transparent material with the neck seal around an opening through which the head is inserted. Furthermore, the hood is in flow communication with a pressurized gas supply source. The hood is then sealed around the user's neck and the hood is pressurized with the gas from the pressurized supply source. An exit exhaust port is left open to provide removal of the expelled gases by the user.

All of the above outlined objectives are to be understood as exemplary only and many more objectives of the invention may be gleaned from the disclosure herein. Therefore, no limiting interpretation of the objectives noted are to be understood without further reading of the entire specification and drawings included herewith.

BRIEF DESCRIPTION OF THE DRAWINGS

The head enclosing gas hood of the present invention will be more clearly understood by reference to the following detailed description and of the preferred embodiment thereof in conjunction with the accompanying drawings, in which.

DETAILED DESCRIPTION OF THE PREFERRED EMBODIMENT

Figure 1:
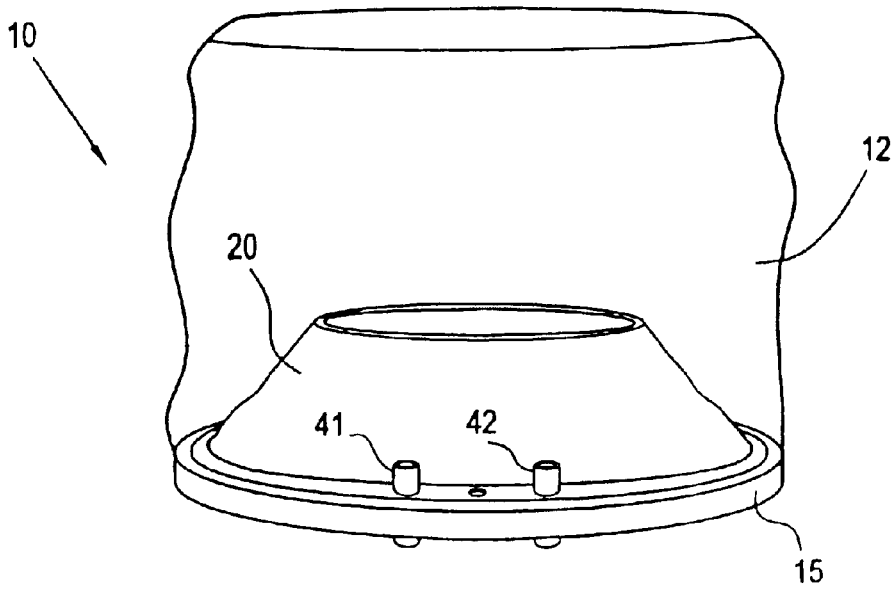
FIG. 1 is a perspective view of the head enclosing gas hood of the present invention.
Figure 9:
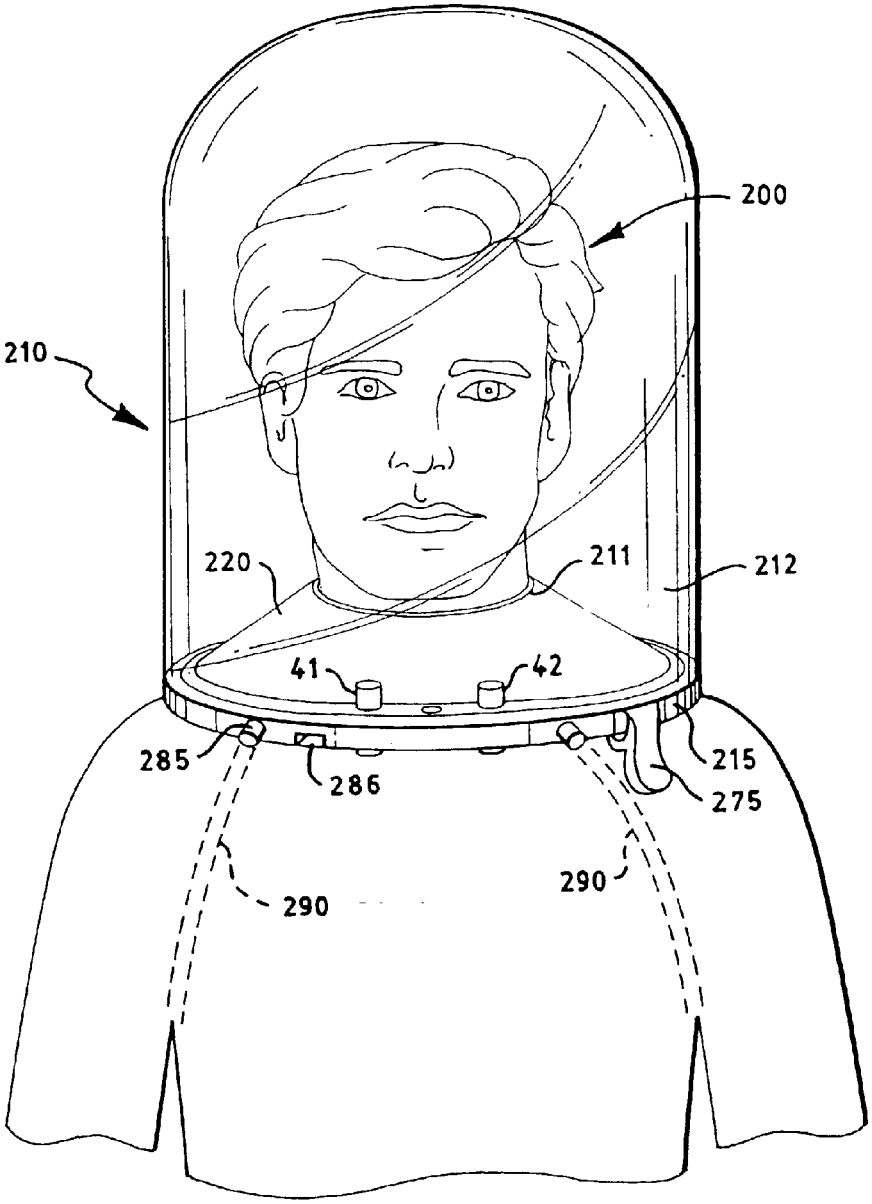
FIG. 9 is a perspective view of a preferred embodiment of the present invention for respiratory ailments in a use condition.
Figure 11:
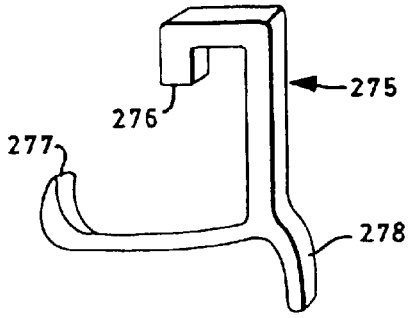
FIG. 11 is a perspective view of a holding clip used in FIG. 9.

The head enclosing treatment hood of the present invention is shown in FIG. 1. As disclosed therein, the gas hood or head tent 10 is comprised of hood portion 12 which is affixed to a hood ring 15. The hood ring slides aver the upper neck ring 46 and lower neck ring 48. Upper and lower rings 46 and 48 have a neck seal 20 compressed therebetween, the neck seal 20 extending inwardly therefrom. Neck seal 20 is provided so that a gas impermeable seal may be made between the hood ring 15 and upper and lower neck rings 46 and 48 and the user's neck when the user's head is inserted into the hood portion 12. First gas port 41 and second gas port 42 are also provided for insertion and removal of gas from within the hood portion 12. First gas port 41 and second gas port 42 extend through the upper neck ring 46 and lower neck ring 48 so that ready access is provided into the interior of the hood portion 12. FIG. 9 shows the gas hood 10 placed over the head of a user 200.

Figure 4:
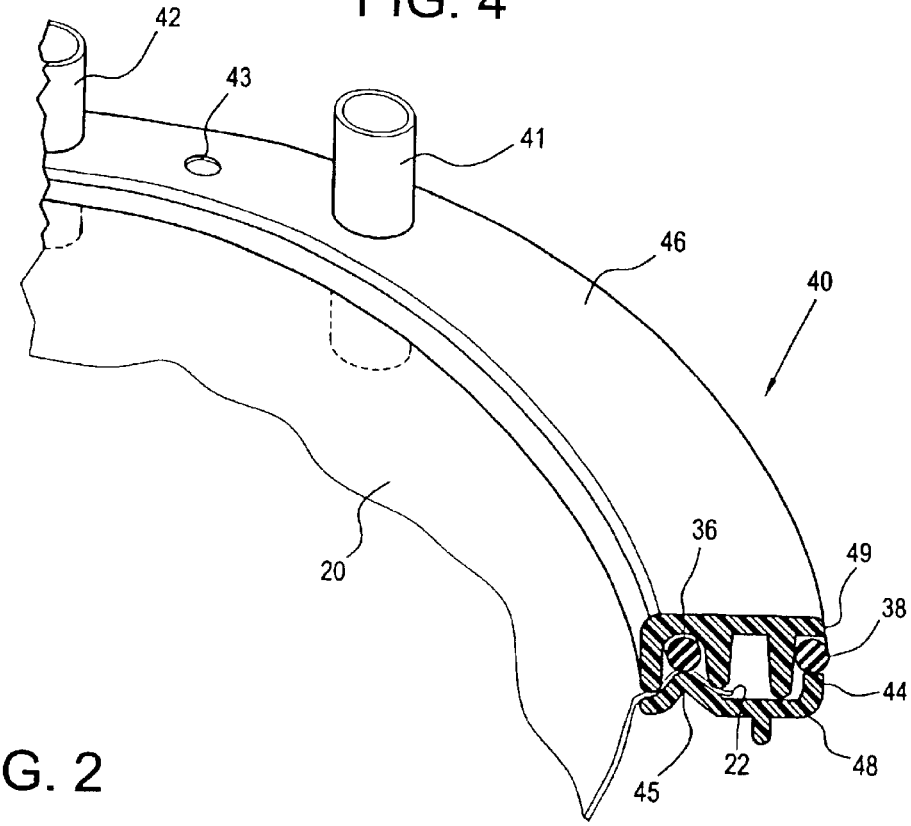
FIG. 4 is a partial sectional view of the assembled two-piece neck ring and neck seal of the present invention.

The gas hood or head tent 10 of the present invention may be utilized to provide an atmosphere for medical treatment or for the simple supply of oxygen or other gases to a patient. The patient may slide the two-piece neck ring 40 as is shown in FIG. 4, and the neck seal 20 over their head such that the individual's head is inserted into the interior of hood 12. The head tent 10 of the present invention thereby seals off the individual's head by providing access to the interior of the hood only through the first and second gas ports 41 and 42. A sealing relationship exists between the hood 12 and hood ring 15 and between the hood ring 15 and the two-piece neck ring 40. Further, the neck seal 20 is sealingly engaged between the upper and lower neck ring 46 and 48 while the neck seal 20 and the hood 12 are made of a gas impermeable material. Thus, for treatment of a patient in need of a controlled specialized environment or in need of a pure oxygen, higher oxygen content breathable air, or other gas mixtures the user may slide the head tent or gas hood 10 of the present invention over their head and a supply line of the gas is placed in flow communication with the interior of hood 12 through first gas port 41. Second gas port 42 may then be utilized to provide an exit flow port of the gas contained therein. By regulating the amount of gas entering and exiting the hood, a positive pressure can be maintained. A preferred range of 5–30 cm $H_2O$ pressure within the hood works best for most therapies.

A two-piece neck ring assembly 40 as is disclosed herein is comprised of an upper neck ring 46 and a lower neck ring 48 and provides advantages for assembly of neck seal 20 in that a secure and tight seal is guaranteed between the neck seal 20 and the two-piece neck ring 40.

Figure 2:
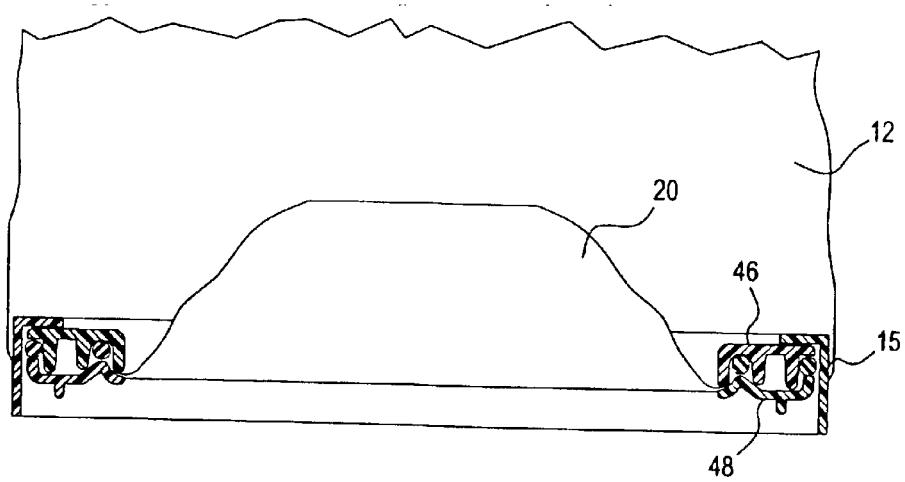
FIG. 2 is a sectional view of the head enclosing gas hood of the present invention.

One important aspect of the present invention is shown in FIG. 2 and in FIG. 4, wherein the two-piece neck ring 40 of the present invention is shown. The two-piece neck ring 40 of the present invention is comprised of an upper neck ring 46 and a lower neck ring 48 which compresses therebetween neck seal 20. Thus, upon manufacturing of the upper and lower neck rings 46 and 48 the neck seal 20 may be assembled therebetween and the two-pieces may be sealingly engaged to each other.

As is shown in FIG. 2 and in FIG. 4, the two-piece neck ring 40 is comprised of the upper neck ring and lower neck ring 46 and 48 as well as a retaining O-ring 36 and a sealing O-ring 38. The retaining O-ring 36 may be compressed between the upper and lower neck rings 46 and 48 in order to hold the neck seal 20 in place. Retaining ring 36 may be placed in an interior groove of the upper neck ring 46 and the neck seal 20 may be held in place by retaining ridge 45 which extends upwardly from the lower neck ring 48.

Figure 13:
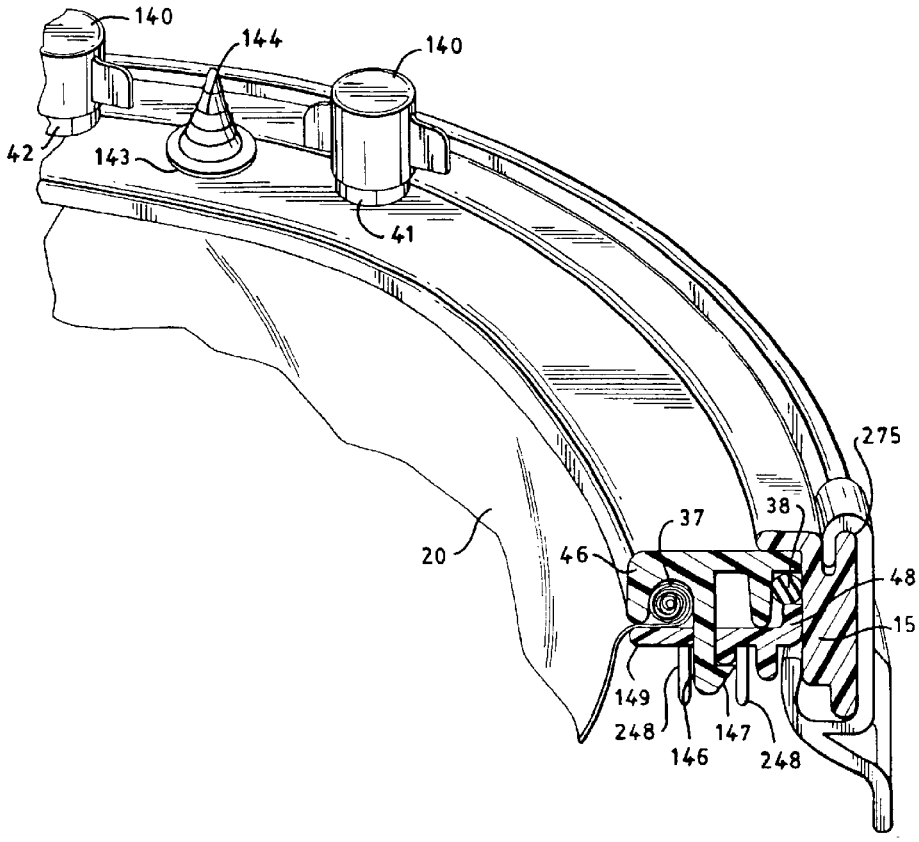
FIG. 13 is a partial sectional view of an assembled gas hood without the transparent hood.

Alternatively, as shown in FIG. 13, retaining O-ring 36 may be eliminated and instead the end of neck seal 20 is rolled into a ring 37 and inserted into the space formerly occupied by retaining O-ring 36. Neck seal ring 37 may be adhesively bonded to neck seal 20 so as to retain its form, or when placed between upper neck ring 46 and lower neck ring 48 retain its shape by compression. Neck seal ring 37 functions identically to retaining O-ring 36 in that neck seal 20 is held in place and a gas-tight seal formed. Retaining ridge 45 may or may not be necessary to assist in the retention of neck seal 20, depending on the circumference of neck seal ring 37.

Figure 17:
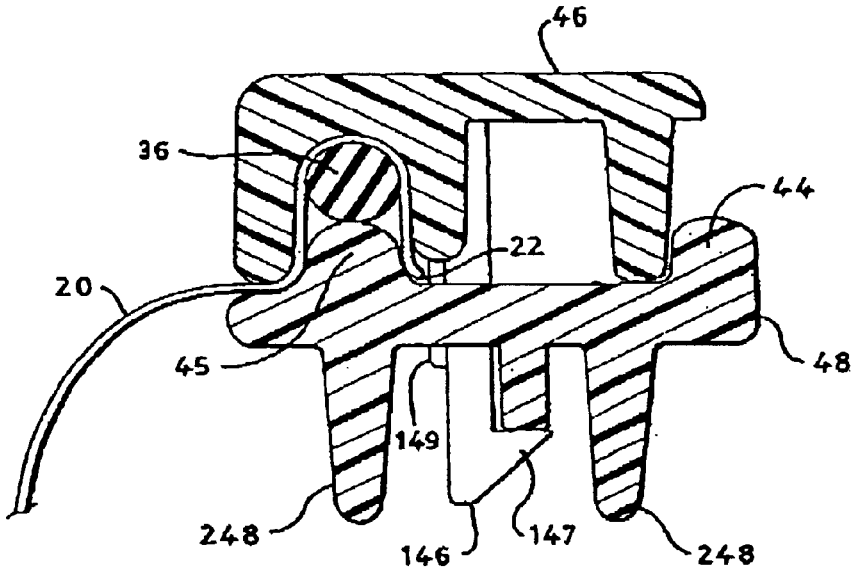
FIG. 17 is a partial sectional view of another embodiment of an assembled gas hood without the transparent hood.

As is shown in FIG. 4, the neck seal periphery 22 of the neck seal 20 may be inserted into the interior portion of the two-piece neck ring 40 and may be retained in place by passing it under retaining ring 36 which will work in conjunction with retaining ridge 45 of the lower neck ring 48. Another embodiment for retaining the neck seal 20 between the upper neck ring 46 and lower neck ring 48 is shown in FIG. 17. The neck seal periphery 22 is passed over the retaining O-ring 36 rather than beneath it. Retaining ridge 45 functions to push retaining O-ring 36 tighter against upper neck ring 46, securely clamping the end of neck seal 20 onto the two-piece neck ring 40. The neck seal periphery 22 is thus placed into the interior of the upper and lower neck ring 46 and 48 and is held in place by the compressive forces of the two rings in combination with retaining ring 36. An additional sealing ring 38 may be provided on the exterior periphery of the two-piece neck ring 40 and placed in between upper neck ring edge 49 and lower neck ring edge 44 as is shown in FIG. 4. Thus, upon assembly of the two-piece neck ring 40, a slight gap will extend vertically between the upper neck ring edge 49 and lower neck ring edge 44 which receives the sealing ring 38. The sealing ring 38 extends slightly outward from the peripheral edge of ring 40 and may then provide a proper seal between the two-piece neck ring 40 and the hood ring 15 as is shown in FIG. 2.

In addition to the sealing structure noted above, the first gas port 41 and second gas port 42 are provided in the two-piece neck ring 40. First and second gas port 41 and 42 are cylindrical members which extend upwardly and downwardly from upper neck ring 46. Lower neck ring 48 has apertures of similar size to the diameter of the first and second gas ports 41 and 42 such that upon assembly of the two-piece neck ring 40, the downwardly extending portion of the ports 41 and 42 may extend through said apertures 31 and 32, shown in FIG. 3. Thus, both the upper and lower neck rings 46 and 48 may be designed to have an aperture which are coaligned and which extend into the interior of the hood 12. As shown in FIG. 13, first and second gas ports 41 and 42 each may be covered with a gas port cap 140 when not in use. Or, when a pressure increase is desired on the interior of the hood 10, one cap 140 can be left on gas port 41 or 42 and removed from the other.

Additionally, a device port 43 may be provided in both the upper neck ring 46 and lower neck ring 48 such that a monitoring device or other instrument may be inserted through two-piece neck ring 40 and into the interior of the hood 12. As previously indicated, first and second gas ports 41 and 42 provide a flow way into and out of the hood 12. Thus, a gas supply line may be affixed to the lower portion of the first gas port allowing a flow of fresh gas into the interior of hood 12. Second gas port 42 may then be utilized as an exit port for removal of the gas. A monitoring device may be inserted through the device port aperture 43 allowing the gas within hood 12 to be monitored. Further, a device port closure 143 may be provided which seals the device port aperture when it is not needed. An exemplary device port closure 143 is shown in FIG. 13. This closure 143 is conical shaped with gradations 144 evenly space along its length. The gradations 144 may be used as a guide to evenly cut off the end of the closure 143 at a desired point. The further down the closure 143 is cut, the larger the diameter of the opening created through the closure 143. Thus, a tight seal can be maintained around a monitoring device regardless of the size of the device.

Figure 6:
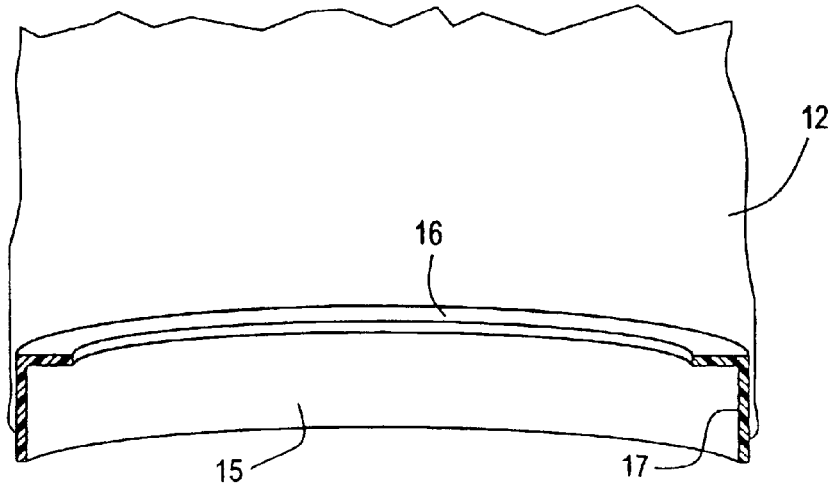
FIG. 6 is a perspective sectional view of the hood ring and hood of the present invention.

As can be seen from FIG. 2, the assembled upper and lower neck rings 46 and 48 retain the neck seal 20 in sealing relationship and allow the hood ring 15 to slide thereover. As can be seen, hood ring 15 for example, may be an inverted L-shaped ring with the hood 12 sealingly attached thereto. Alternative designs however are available and are within the scope of this teaching. The hood ring slides over the assembled upper and lower neck rings 46 and 48 allowing the sealing ring 38 to engage the hood ring working surface 17, as shown in FIG. 6. As shown in FIG. 2, a slight spacing in between the sealing ring 38 and the hood ring is depicted for ease of discussion. However, in actual use, the hood ring will sealingly engage the hood ring 15 to provide a gas impermeable connection between the hood ring 15 and upper and lower neck rings 46 and 48.

Figure 3:
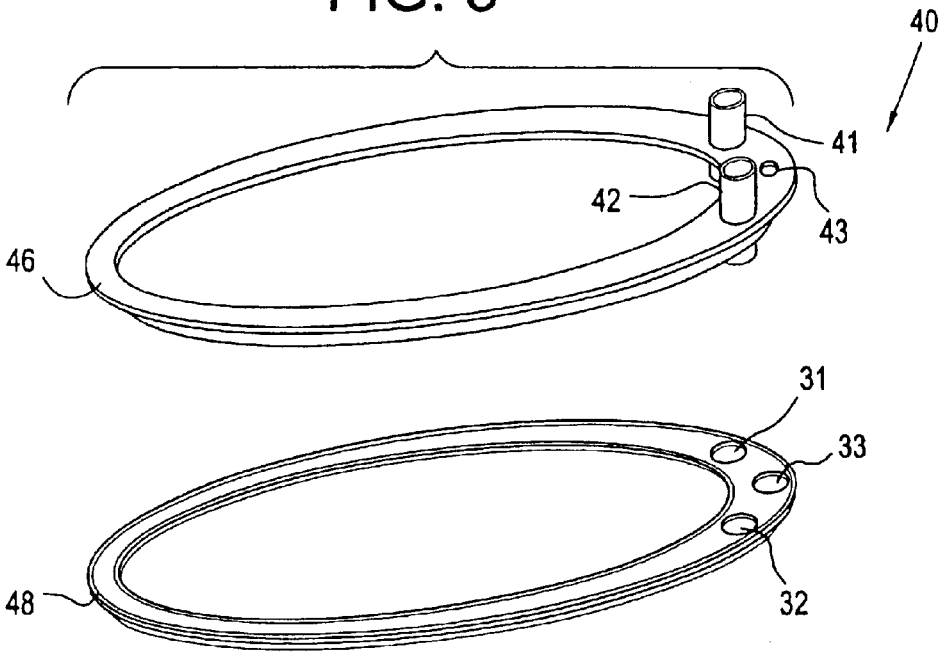
FIG. 3 is an exploded view of the two-piece neck ring of FIG. 1.

Turning to FIG. 3, the two-piece neck ring 40 of the present invention is shown in an exploded view. The two-piece neck ring 40 is comprised of upper neck ring 46 and lower neck ring 48. Also shown therein are the cylindrical first gas port 41 and second gas port 42. Device port 43 is provided for access into the interior of hood 12. The ports 41 and 42 as depicted are cylindrical in design, but any shape may be utilized as long as a gas flow may be provided through the neck ring 40. Also as is shown in FIG. 3, first access aperture 31 and second access aperture 32 are provided such that the lower extending portion of the ports 41 and 42 may extend downward through the lower neck ring 48 and be readily accessible. Also shown in FIG. 3 is the third access aperture 33 through which the device port 43 may be utilized. Not shown in FIG. 3 is the retaining ring 36 and the sealing ring 38 which are compressed between the upper neck ring and lower neck ring 46 and 48 upon assembly.

Figure 14:
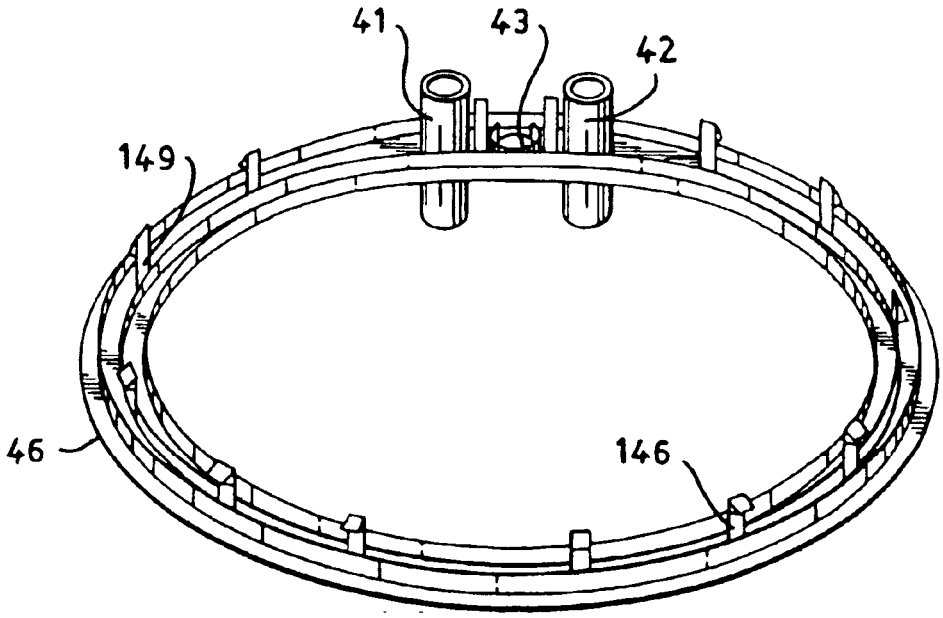
FIG. 14 is a perspective view of the bottom side of the lower neck ring.
Figure 15:
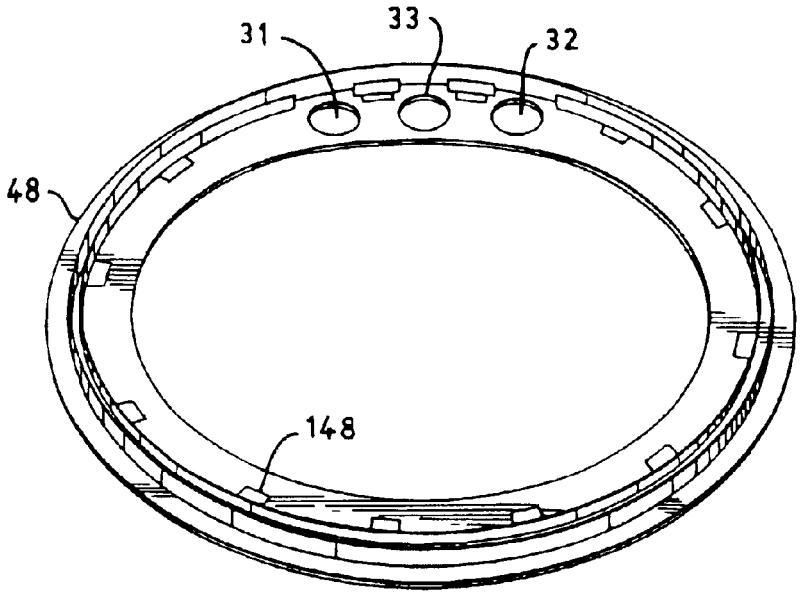
FIG. 15 is a perspective view of the bottom side of the upper neck ring.

The upper neck ring 46 and lower neck ring 48 are compressed together thereby retaining the rings 36 and 38 therebetween. The upper and lower neck rings 46 and 48 may be held together by snap fit as exemplified in FIG. 13, or may be retained in compressive relationship by threaded screws or through welding, heat application or other means. As shown in FIG. 14, upper neck ring 46 may contain a plurality of hooks 146 spaced along its perimeter. An equal number of aligned apertures 148 in lower neck ring 48, as shown in FIG. 15, permit passage of grasping ridge 147 on the end of hooks 146 through the apertures 148, as shown in FIG. 14. Grasping ridge 147 lockingly engages the underside of lower neck ring 48 so as to snap fit bind upper and lower neck rings 46 and 48 together. A retaining ridge or bead on the underside of lower neck ring 48 where grasping ridge 147 contacts lower neck ring 48 may be provided to facilitate the snap fit bind. FIG. 17 demonstrates how clip retention hub 149 may be formed onto the side of hook 146 in order to force grasping ridge 147 to more tightly and permanently engage lower neck ring 48. Various other known methods may be utilized to retain the upper and lower neck rings 46 and 48 in compressive relationship, any one of which may be selected.

The upper and lower neck rings 46 and 48 as well as the hood ring 15 may be made of a hardened plastic material such that they may be injection molded. It is therefor desirable that they may be made of a hardened plastic material so as to firmly hold the retaining ring 36 and sealing ring 38 in place and provide a rigid contacting surface for the rings and for the neck seal 20 to engage. It is further desirable that the hood ring 15 be able to readily slide over the exterior periphery of the two-piece neck ring 40 wherein the seal ring 38 extends slightly outward therefrom.

As shown in FIG. 6, the hood ring 15 has a working surface 17. The hood ring working surface 17 of the present invention is the interior surface of the hood ring 15 which engages the seal ring 38 of two-piece neck ring 40. The working surface 17 may extend from the top rim portion 16 of hood ring 15 and downward therefrom. The hood ring working surface 17 is that portion of the hood ring which engages the seal ring 38 of the two-piece neck ring 40. It is preferable, as is shown in FIG. 6, that the hood ring working surface 17 of hood ring 15 not have any portion of the hood 12 affixed thereto. Thus, as is shown in FIG. 6, the hood 12 is sealingly affixed to the exterior wall of the hood ring 15. The hood 12 as is shown in FIG. 6 does not cover any portion of the hood ring working surface 17. The hood ring working surface 17 thus is free to engage the seal ring 38 to provide a firm and air tight seal between two-piece neck ring 40 and the hood ring 15. Multiple variations are therefor available for affixation of the hood 12 to the hood ring 15. The hood 12 may be attached to the exterior surface of the hood ring 15 as is shown in FIG. 6 or it may affixed to a portion of the top rim 16 of ring 15. The hood 12 may therefor extend downwardly to the interior portion of the top rim 16 and adhesively affixed to the underside of top rim 16 or it may extend downward along the exterior portion of the ring 15 as is depicted. Of import, however is that the hood ring 15 have a hood ring working surface which is not encumbered by the hood 12 of the head tent 10 of the present invention.

Figure 18:
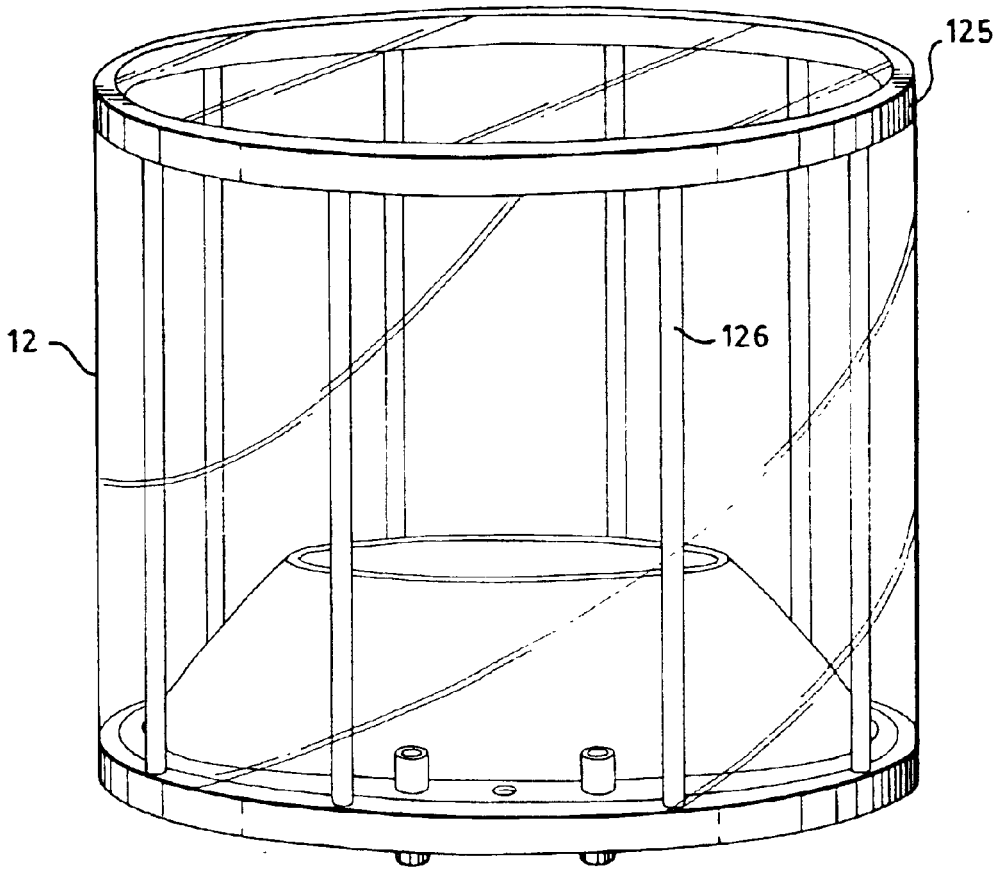
FIG. 18 is a perspective view of another embodiment of the head enclosing gas hood of the present invention.

The hood 12 of the present invention may be made of a clear plastic material which is gas impermeable. The hood 12 is preferably made of a transparent plastic so that the user may see through the hood 12. The hood 12 may be manufactured of a material that is self-supportive of its structure, or other additional means may be utilized. In FIG. 18, the hood 12 has a structural cage 125 attached to it that supports the form of the hood 12 and prevents it from collapsing onto the patient's head and face. The structural cage may be stiff bands of plastic 126 or related material positioned in vertical rows around the surface of the hood 12, or it may be a combination of vertical and horizontal bands. Alternatively, the structural support may be ribs of air pockets spaced around the hood 12. These ribs when inflated with air provide structural support to the hood 12. The support structure, in whatever form, provides rigidity to the hood 12 and assists in maintaining the proper shape of the hood 12 while in use. The support structure will prevent ballooning of the hood 12 when the hood is subjected to positive pressure as well as preventing the hood from collapsing under its own weight when used in a neutral pressure environment.

The interior volume of the hood 12 can vary according to need and still fall within the scope of the present invention. The interior volume of the hood 12 may vary depending on the therapeutic needs. Patient preference and comfort are also factors affecting the choice of hood volume. For example, a smaller hood volume may be desirable for therapies requiring positive pressure in the hood because the required pressure can be reached more quickly with a smaller volume hood 12. Smaller hood volumes may require an increase in airflow through the hood since carbon dioxide will increase at a more rapid rate than the larger hood volumes due to respiration by the patient. Hood volume may be varied either by increasing or decreasing the diameter of the hood ring 15 and two-piece neck ring 40 or by extending the sides of the hood 12 outward or upward. In one embodiment, the hood ring has a diameter of between about ten to twelve inches.

As shown in FIG. 2, the hood 12 is affixed to the exterior portion of hood ring 15 and may be attached thereto through the use of adhesives or welding. The means of attachment of the hood 12 to the hood ring 15 may be utilized when the hood is affixed to the exterior surface of the hood ring 15 or to the underside of top rim 16 so long as the lower periphery of the hood 12 is not located on the hood ring working surface 17.

Figure 5:
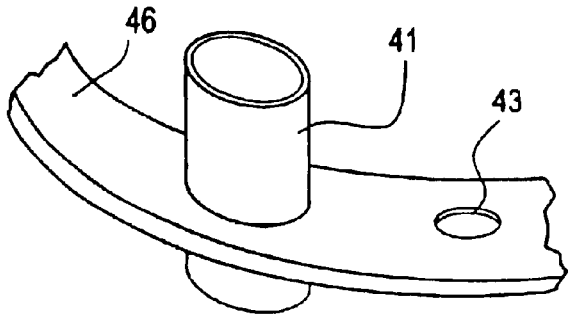
FIG. 5 is a close-up perspective view of the upper neck ring of the present invention.

The two-piece neck ring 40, shown in FIG. 4, is comprised of the upper neck ring 46 and lower neck ring 48. As indicated, the first gas port 41 is cylindrical in design and extends upwardly and downwardly from the upper neck ring 46. As shown in FIG. 5, a portion of the upper neck ring 46 is indicated with the first gas port 41 clearly depicted therein. Also shown in the closeup is the device port 43 which allows monitoring devices to be extended through the upper and lower neck rings 46 and 48 into the interior of hood 12. As shown in FIG. 5, first gas port 41 extends upwardly and downwardly from upper neck ring 46 such that the lower extension extends through the first access aperture 31 of the lower neck ring 48 shown in FIG. 3. Thus, the lower extension of the first and second gas ports 41 and 42 are readily accessible underneath the lower neck ring 48 and may be connected to an air supply and air removal system.

Figure 7:
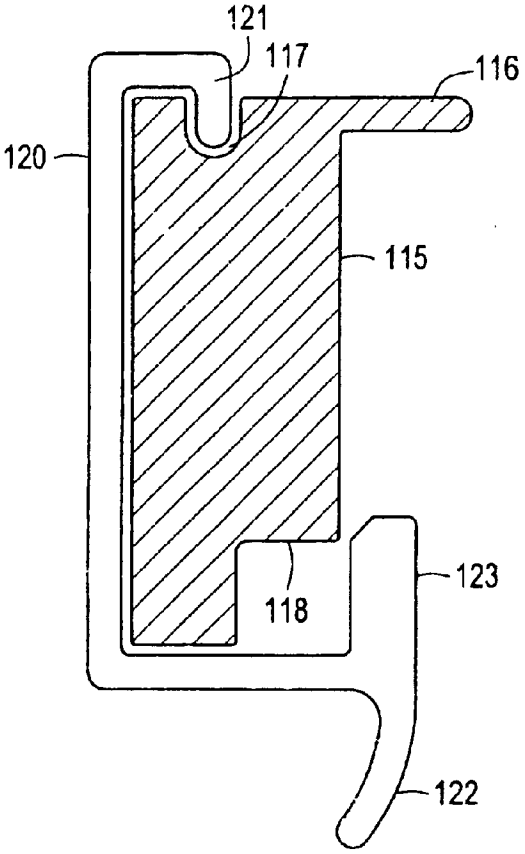
FIG. 7 is a close up sectional view of an alternative embodiment of the hood ring and neck ring of the present invention.

Turning to the alternative embodiment of the present invention shown in FIG. 7, the hood ring 115 may have a small annular groove 117 for receiving a locking clip 120. Locking clip 120 may be utilized to retain the hood ring 115 attached to the two piece neck ring 40. As is shown in FIG. 7, the locking clip 120 has an upper clasp 121 which extends downward and into groove 117. Clasp 121 retains the clip 120 in place. Locking clip 120 may be utilized to keep the ring 115 firmly affixed to the neck ring 40 when an increased pressure is used inside hood 12. By increasing the pressure within the hood 12, downward force will be visited upon the neck ring 40 as the neck ring 40 and hood ring 115 attempt to separate. Locking clip 120, having upwardly extending retaining edge portion 123, prevents the downward movement of the neck ring 40 from occurring.

Figure 8:
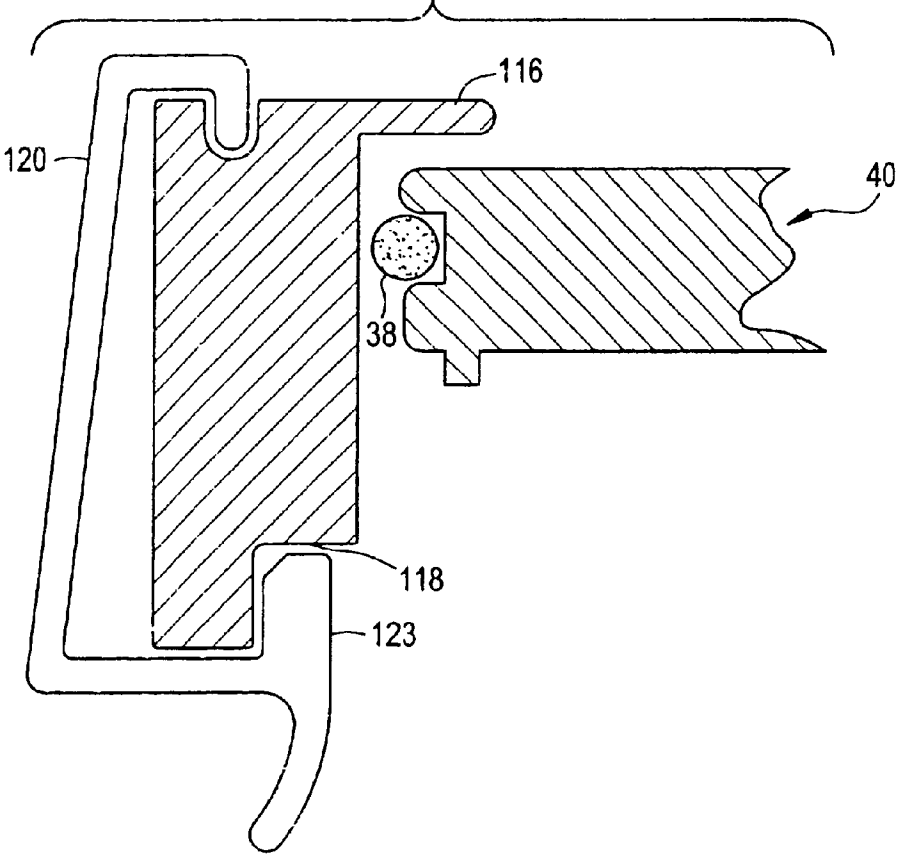
FIG. 8 is a close up sectional view of an alternative embodiment of the hood ring and neck ring of the present invention with the neck ring attached thereto.

Hood ring 115 can also be modified to include recess 118 for receiving the locking clip 120 in the unlocked position as is shown in FIG. 8. The neck ring 40 may then move freely downward away from the top inwardly directed edge 116 retaining the neck ring 40 in place. Clip 120 may have grasping tongue 122 for pulling the retaining edge portion 123 away from the inner surface of the hood ring 115. Thus, FIG. 7 depicts the locking clip 120 in a fully locked position with the retaining edge portion 123 extending upwardly directly below the neck ring 40, not shown in FIG. 7. In FIG. 8, the locking clip 120 is moved into the unlocked position, allowing retaining edge 123 to be placed in the recess 118 so that the neck ring 40 can be separated from the hood ring 115.

Another preferred embodiment of the present invention is shown in FIGS. 9–12 wherein the gas hood of the present invention is particularly useful for respiratory therapies which include, but are not limited to, for example, continuous positive airway pressure (CPAP), oxygen therapy, reanimation, intensive care, pneumatology and non-invasive positive ventilation. The gas hood may be used with not only oxygen therapy, but also with a mixture of other gases, including but not limited to nitrogen, carbon dioxide, and helium. For example, CPAP therapy with a mixture of helium and oxygen (heliox) may be useful as a treatment for chronic obstructive pulmonary disease and acute asthma. It has been proposed that since heliox is less dense than air and oxygen, using it may improve gas flow through partially obstructed airways. Therefore, utilized in conjunction with the gas hood of the present invention, heliox may be helpful in the treatment of diseases where the airway is partially obstructed. If CPAP therapy is used with a hood of the present invention, then a means of controlling the exhaust rate of gases is incorporated into the hood. The controlling means may be a limited diameter cap fixed over an exit port such as second gas port 42. Another example of a means of controlling the exhaust rate of gases during CPAP therapy can be a variable dial-up valve mounted on an exit port to permit a adjustment of gas outflow.

Figure 12:
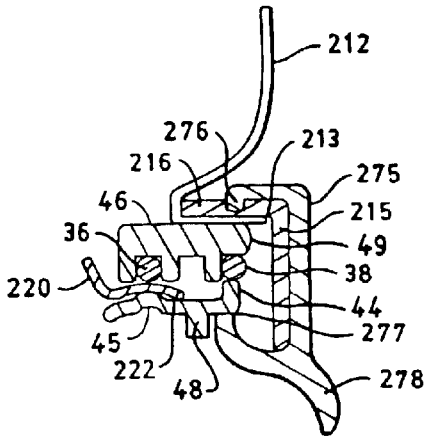
FIG. 12 is a sectional view in detail of the assembly of a gas hood of FIG. 9.
Figure 10:
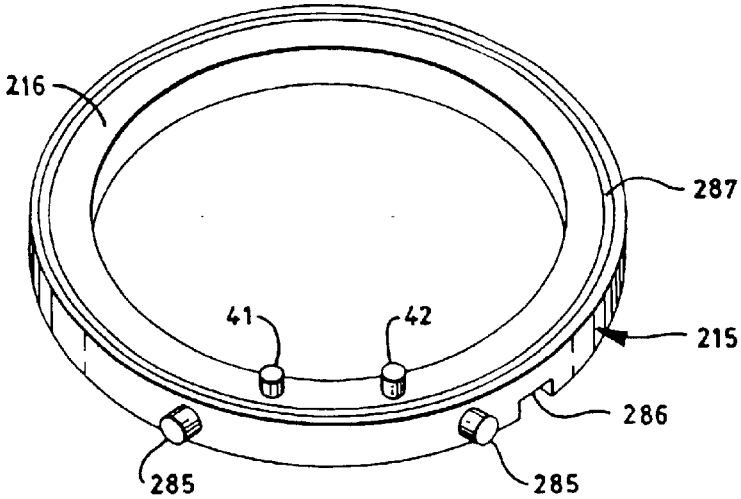
FIG. 10 is a perspective view of a hood ring used in FIG. 9.
Figure 16:
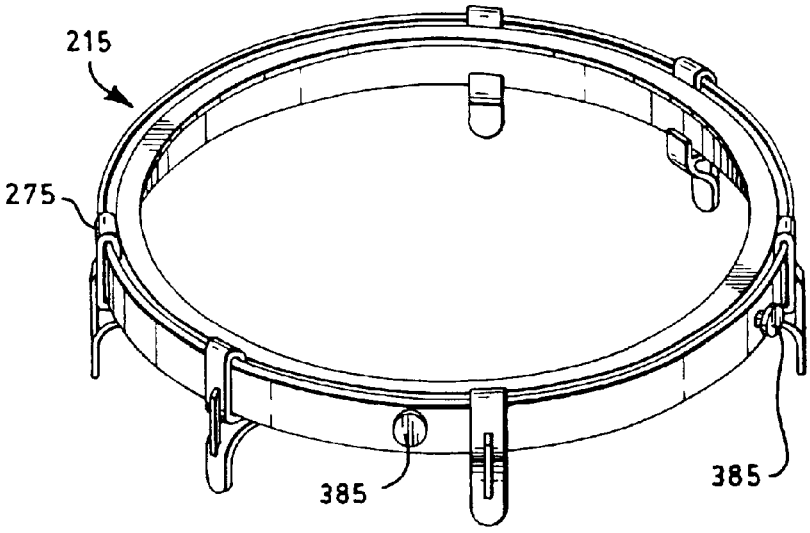
FIG. 16 is a perspective view of an assembled gas hood without the transparent hood.

As shown, a hood ring 215 (FIG. 10) slides over the upper neck ring 46 and lower neck ring 48, as shown in FIG. 12. The hood ring 215 is similar to the hood ring 15, but includes an inwardly directing edge 216 which includes a circumscribing groove 287 therein, groove 287 receiving a groove engaging tip 276 of a locking clip 275. Moreover, the hood ring 215 includes a cut out 286 for receiving a lower ring engaging tip 277 of the locking clip 275 thereunder. The hood ing 215 also includes a pair of strap holding tabs 285, as shown on the front of the hood ring 215, and corresponding tabs on the back side of the hood ring 215 (not shown). Strap tabs 285 receive shoulder traps 290 as shown in phantom lines in FIG. 9. The shoulder straps 290 being attached to the hood ring 215 fit a patients underarm to prevent the hood 210 from disengaging from the shoulders of a patient 200 when pressure is received within the hood 210. For example, during CPAP therapy, the pressure inside the hood will be greater than ambient air outside the hood and tabs 285 in conjunction with straps 290 will keep the hood 210 securely on the patient. In contrast, during oxygen therapy, the air pressure inside the hood 210 remains in equilibrium with ambient air pressure and therefore, it may not be necessary to utilize tabs 275 and straps 290. An alternative strap holding tab 385 is shown in FIG. 16.

FIG. 12 shows an assembly of the gas hood 210 using the locking clip 275 to prevent the separation of the upper and lower neck rings 46 and 48, respectively, when a patient is receiving pressurized gas. The upper and lower neck rings 46 and 48, are assembled in the same manner as discussed previously and as shown in FIG. 4. However, in FIG. 12, the hood ring 215 receives on its underside of the inwardly directing edge 216, the terminating end 213 of the transparent hood 212. The terminating end 213 may be adhesively secured to the underside of the edge 216 or secured by welding or any other well known means for attachment. The terminating end 213 is disposed between the edge 216 and the upper neck ring 46. The neck seal 220 is sealingly engaged between the upper and lower neck ring 46 and 48 as the neck seal periphery 222 is inserted into the interior portion and retained in place by retaining ring 36 in cooperating relation with retaining ridge 45 of lower neck ring 48. Additional sealing ring 38 is provided on the exterior periphery between the upper neck ring 46 and the lower neck ring 48 at the upper neck ring edge 49 and the lower neck ring edge 44. The lower engaging tip 277 of the locking clip 275 is inserted through cut out 286 and engages with the edge 44 and the groove engaging tip 276 is engagable within the groove 287 wherein the engaging tips 276 and 277 prevent the separation of the hood ring 215 and the upper and lower neck rings 46 and 48, respectively, when in use. Grasping tongue 278 is provided for pulling the lower engaging tip 277 from engagement with the lower neck ring 48. Usually, there are a plurality of locking clips 277 spaced around the hood ring 215 and preferably 4 to 6 of these clips are utilized to keep the three rings 215, 46, and 48 from separating when the gas hood 210 is in use.

As shown in FIG. 9 in the use of the gas hood 210 for respiratory ailments, the gas hood 210 is placed over the head 200 of a user. The neck seal 220 is made of a flexible elastomeric material and has an opening 211 cut therein, opening 211 being cut to sealingly engage with the neck of the user 220. The treatment hood 210 is then sealed around the user's neck and a pressurized gas, such as oxygen from a pressurized supply source, enters the hood through port 41. Port 42 is left open allowing exhaust of gases, particularly carbon dioxide, expelled by the user from the interior of the hood 210. The amount of gas pressure within the hood may be increased, decreased or kept the same as the external air pressure by varying the flow rate of gas into the hood from the pressurized supply source in combination with controlling the flow rate of gas exhaust from the hood.

While certain specific relationships materials and other parameters have been detailed in the above description of the preferred embodiments, these descriptions and structures may be varied where suitable with similar results. For example, as shown in FIG. 17, hook stand-off ridges 248 may be formed as appendages on the bottom of lower neck ring 48 and projecting downward toward the patient's shoulders. The ridges, which run parallel to each other and may circumscribe up to the entire lower neck ring 48, function to prevent hooks 146 from contacting the patient. Such contact, if permitted, might snag clothing or cause discomfort to the patient when wearing the apparatus.

Other application variations and modifications of the disclosed head enclosing treatment hood will occur to those skilled in the art upon reading the present disclosure. Such modifications, while potentially being different in structure, are intended to be included within the scope of this invention as defined in the amended claims.

What is claimed is:

1. A head enclosing treatment hood, comprising:

a hood affixed to a hood ring;

a two piece neck ring affixed to said hood ring comprised of an upper neck ring having a plurality of downwardly extending hooks and a lower neck ring having a plurality of apertures through which said hooks extend, wherein said hooks lockingly engage said lower neck ring to fixedly join said upper neck ring and said lower neck ring together;

at least one gas port in flow communication with a source of gas and the interior of said hood; and a neck seal extending inwardly from said two piece neck ring wherein said neck seal is compressively disposed between said upper neck ring and said lower neck ring.

2. The hood of claim 1, said hood ring including a plurality of strap holding tabs.

3. The hood of claim 1, each of said downwardly extending hooks having a grasping ridge at one end.

4. The hood of claim 3, each of said downwardly extending hooks farther having a clip retention hub on a surface opposite said grasping ridge and in contact with said lower neck ring so as to bias said grasping ridge more tightly against said lower neck ring and lockingly engage said hook with said lower neck ring.

5. The hood of claim 1, said lower neck ring component having at least one hook stand off ridge downwardly extending from the bottom side of said lower neck ring.

6. The hood of claim 5, said hook stand off ridge extending below said lower neck ring for a distance greater than a length of each of said hooks when said upper neck ring and said lower neck ring are lockingly engaged.

7. The hood of claim 5, said hook stand off ridge circumscribing said lower neck ring.

8. The hood of claim 5 having two hook stand off ridges.

9. The hood of claim 8, said two stand off ridges positioned on either side of said aperture on said lower neck ring.

10. The hood of claim 1, said upper neck ring and lower neck ring having a retaining mechanism between them and in frictional engagement with said neck seal.

11. The hood of claim 10, said retaining mechanism being a retaining ridge extending upward from said lower neck ring and an O-ring positioned in a groove in said upper neck ring and wherein said retaining ridge, said O-ring and said neck seal are in compressional contact.

12. The hood of claim 11, said O-ring being sandwiched between and in direct contact with said ridge and said neck seal.

13. The hood of claim 11, said neck seal being sandwiched between and in direct contact with said O-ring and sad retaining ridge.

14. The hood of claim 10, said neck seal having a peripheral end rolled to form a gasket and said peripheral rolled end in frictional contact with said upper and lower neck ring.

15. The hood of claim 1, said hood having a first gas port and a second gas port.

16. The hood of claim 15, said first and second gas ports having caps detachably affixed to said gas ports.

17. The hood of claim 1, said two piece neck ring having a device port extending therethrough.

18. The hood of claim 17, said device port having a device port closure sealing said device port when not in use.

19. The hood of claim 18, said device port closure comprising a conical-shaped cap with a plurality of gradations wherein the end of said cap is cut off at said gradation that produces an opening with a diameter substantially equivalent to a diameter of a monitoring device to be inserted through said opening.

20. The hood of claim 1, said hood having a structural cage attached thereto.

21. The hood of claim 20, said structural cage being comprised of stiff bands of plastic arranged in vertical rows along said hood.

22. The hood of claim 20, said structural cage being comprised of ribs of air pockets spaced around said hood.

23. A head enclosing treatment hood, comprising:

a hood affixed to a hood ring;

a two piece neck ring affixed to said hood ring comprised of an upper neck ring having a plurality of downwardly extending hooks and a lower neck ring having a plurality of apertures through which said hooks extend and wherein said hooks lockingly engage said lower neck ring to fixedly join said upper neck ring and said lower neck ring together;

at least one locking clip removably retained on said hood ring and retaining said neck ring to said hood ring; and a neck seal extending inwardly from said two piece neck ring wherein said neck seal is compressively disposed between said upper neck ring and said lower neck ring.

24. A head enclosing treatment hood, comprising:

a hood affixed to a hood ring;

a two piece neck ring retained under said hood ring having of an upper neck ring, said upper neck ring having a plurality of downwardly extending hooks, and a lower neck ring having a plurality of apertures through which said hooks extend;

wherein said hooks engage said lower neck ring along a retaining bead circumscribing a lower side of said lower neck ring to fixedly join said upper neck ring and said lower neck ring together;

a neck seal extending inwardly from said two piece neck ring wherein said neck seal is compressively disposed between said upper neck ring and said lower neck ring.

25. A head enclosing treatment hood, comprising:

a hood affixed to a hood ring;

a two piece neck ring sealingly combined with said hood ring having of an upper neck ring, said upper neck ring having a plurality of downwardly extending hooks, and a lower neck ring having a plurality of apertures through which said hooks extend;

wherein said hood has a structural cage formed integrally within said hood;

a neck seal extending inwardly from said two piece neck ring wherein said neck seal is compressively disposed between said upper neck ring and said lower neck ring.

26. A head enclosing treatment hood, comprising:

a hood affixed to a hood ring;

a two piece neck ring sealingly combined with said hood ring having of an upper neck ring, said upper neck ring having a plurality of downwardly extending hooks, and a lower neck ring having a plurality of apertures through which said hooks extend;

said neck ring having a plurality of gas ports and at least one device port formed therein;

a neck seal extending inwardly from said two piece neck ring wherein said neck seal is sealingly engaged compressively disposed between said upper neck ring and said lower neck ring.

27. A head enclosing treatment hood, comprising:

a hood affixed to a hood ring;

a two piece neck ring sealingly combined with said hood ring having of an upper neck ring, said upper neck ring having a plurality of downwardly extending hooks, and a lower neck ring having a plurality of apertures through which said hooks extend;

a neck seal extending inwardly from said two piece neck ring wherein said neck seal is compressively disposed between said upper neck ring and said lower neck ring by an O-ring seal, said O-ring seal compressed between said upper neck ring and said lower neck ring by a retaining ridge;

a plurality of hook standoff ridges extending downward from said lower neck ring about said downwardly extending hooks of said upper neck ring and extending below a lower edge of said hooks.

* * * * *